United States Patent [19]

Roberts et al.

[11] 4,157,208

[45] Jun. 5, 1979

[54] WATERPROOF SPLICE ELECTRICAL CONNECTOR

[75] Inventors: Lincoln E. Roberts, Dunedin; Walter M. Young, Pinellas Park, both of Fla.

[73] Assignee: AMP Incorporated, Harrisburg, Pa.

[21] Appl. No.: 850,584

[22] Filed: Nov. 11, 1977

[51] Int. Cl.[2] ..... H01R 7/04

[52] U.S. Cl. ..... 339/98; 339/117 R; 339/274

[58] Field of Search ..... 339/94, 97 R, 97 P, 339/98, 99 R, 117 R, 274

[56] References Cited

U.S. PATENT DOCUMENTS

| | | | |
|---|---|---|---|
| 3,573,713 | 4/1971 | Enright et al. | 339/98 |
| 3,675,182 | 7/1972 | Gregory | 339/98 |
| 3,980,380 | 9/1976 | Cieniawa et al. | 339/99 R |
| 4,039,243 | 8/1977 | Johnson | 339/274 |

FOREIGN PATENT DOCUMENTS

| | | | |
|---|---|---|---|
| 1640633 | 10/1969 | Fed. Rep. of Germany | 339/97 R |

*Primary Examiner*—Joseph H. McGlynn
*Attorney, Agent, or Firm*—Anthony S. Volpe

[57] ABSTRACT

A rotary waterproof splice connector for use with a plurality of insulated wires is disclosed. The connector includes two mutually rotatable cylindrical insulating members. Wire receiving tubular passages parallel to the axis of rotation intersect a plate-like contact terminal. Rotation of the two insulating members causes the terminal to establish electrical contact with wires located in the tubular passages. A viscous sealant is stored in the tubular passages at the interface between the wires and the terminal.

10 Claims, 11 Drawing Figures

26
92a
94
4
92b
112
70
96
98
114
4
70
4
70
108
110
120
113
118
84

WATERPROOF SPLICE ELECTRICAL CONNECTOR

BACKGROUND OF THE INVENTION

1. Field of the Invention

This invention relates to devices having means such as an edge of a slotted plate for penetrating the insulation and making electrical contact with the conductor in which common means cause plural penetrating means to simultaneously engage plural conductors. This invention also relates to connectors in which the conductive portions are immediately surrounded by sealing means which exclude air, moisture and foreign matter. This invention also relates to structure, having means for providing a tight seal between the end structure and the conductor element passing therethrough to the exterior.

2. Description of the Prior Art

A number of connectors for establishing a waterproof splice between a plurality of electrical conductors are known in the art. For example, U.S. Pat. No. 3,410,950 discloses an insulated moisture-proof connecting device utilizing slotted plate members to penetrate the insulation of a pair of conductors to form a splice. A moisture-proof sealant is provided. As the individual wires are terminated, the sealant flows around the interface between the wire and the connector.

A number of moisture-proof electrical connectors utilize a two-piece rigid insulating housing. The two-piece housings utilized in these connectors are positioned in telescoping relationship. Slotted plate contact terminals having wire termination means are generally affixed to one of the two parts of the connector. Wires can be located in alignment with the wire terminating means located on the interior of the housing. As the two housing members are squeezed together, the slotted plate wire termination means penetrates the surrounding conductor insulation and establishes electrical contact with the conductive core. Typically, a moisture-proof sealant is encapsulated within the two-piece housing. As the two pieces are pressed together, the moisture-proof sealant flows around the interface between the contact terminating means and the conductors. U.S. Pat. No. 3,718,888 discloses an electrical connector typical of two-piece telescoping, piston connectors. A device embodying the general principles of U.S. Pat. No. 3,012,219, and shown in U.S. Pat. No. 3,656,088, utilizes a moisture-proof sealant.

Connectors of this type can typically be terminated by utilizing a pair of pliers to squeeze the two housing parts together. Cartridge type termination tools can also be used with connectors of this type. One example of a cartridge type termination tool is found in U.S. Pat. No. 3,707,867. This tool is utilized with a version of a connector shown in U.S. Pat. No. 3,656,088 employing the principles of the device shown in U.S. Pat. No. 3,012,219 referred to above. This version of that connector is depicted in U.S. Pat. No. 3,707,867.

Termination of conductors in these two-piece piston connectors results in a reduction in the interior volume of the connector assembly. As a result, the moisture-proof sealant stored in the connector is "pumped" through the conductor receiving passageways and out of the connector. Statistically, this pumping action tends to result in unsealed gaps, exposing the electrical contact interface to moisture. Another type of failure which has been encountered is the creation of capillary-like passages in the sealant as entrapped air is subjected to a pressure differential during termination and forced through the viscous sealant.

Piston-type connectors do not readily lend themselves to complete encapsulation of the sealant. Since there is a marked decrease in the interior volume of a piston-type connector during termination, initially filling the inner chamber results in an excessive overflow during termination. A partially filled inner chamber results in the pumping of air and sealant during termination. This simultaneous pumping can result air passages and unsealed gaps.

An additional problem is the mess created by the overflow of sealant during wire insertion and termination. This excess sealant might also clog up the tool, used to terminate the connector.

Finally, the piston-type connectors can suffer from adverse temperature-cycling effects, which are especially significant in the presence of entrapped air. The coefficient of expansion of air is markedly different from that of the connector components, or the grease. The larger volume changes of the entrapped air due to a given change in temperature leads again to an undesirable pumping action and results in an alteration of the connector-sealant configuration. Such pumping would result in the creation of external air passages allowing the entrance of water.

SUMMARY OF THE INVENTION

A rotary electrical connector having an outer insulating casing and a rotatable inner insulating plug member with a generally flat metallic plate-like wire terminating member mounted on the plug member is disclosed and claimed. This connector member can be used to attach a wire to a terminal element or to splice a plurality of wires. A plurality of wire terminating slots are located in the plate-like member. The metallic wire terminating member is rotatable with respect to the plug member and is fixed relative to the outer casing. A plurality of axially extending wire receiving tubular passages extend through the inner plug member and across the metallic plate-like member. As the outer casing is rotated relative to the plug member, the plate-like member rotates, and the edges of the slots establish electrical contact with the underlying conductive core of each wire. A moisture-proof sealant is encapsulated in the tubular passages of the plug member adjacent the intersection of the metallic plate-like member and the tubular passages. Due to the rotary terminating action of the connector, only a relatively insignificant pressure differential acts upon the sealant in the tubular passages during termination.

A connector having the previously mentioned characteristics satisfies the need for a moisture-proof electrical connector for splicing two or more electrical conductors. Connectors of this type are needed in various applications, for example, in the termination of telecommunications cables in adverse environments. A more specific object satisfied by a connector of this type is to provide a connector which does not "pump" the sealant stored within the connector through the external conductor receiving passages during splicing of the connectors. The absence of sealant "pumping" eliminates the formation of small capillary-like tunnels extending through the sealant caused by the escape of air initially trapped within the connector casing and placed under pressure during the termination of the conductors. Another object of this invention is to provide a connector which can be easily actuated to splice a plurality of conductors. The connector disclosed and claimed herein can be actuated using a simple pliers-like tool or a magazine fed tool of the type shown. It is also an object of this invention to provide a connector in which wires can be easily loaded into the connector and which can be used in a field environment.

DESCRIPTION OF THE DRAWINGS

FIG. 3 is a transverse section showing the various components of the connector in the unterminated position.

FIG. 8 is a section through the terminating section of a suitable hand tool showing connectors in their unterminated positions.

DETAILED DESCRIPTION OF THE INVENTION

A rotary electrical connector is disclosed and claimed herein. The preferred embodiment is intended for use in splicing a plurality of insulated wires. The principle of this invention is not limited to splicing alone. A similar rotary device could be used to attach wires to terminal elements. In any such embodiment, however, the connector is especially adapted for use as a moisture-proof connector.

Figure 1:
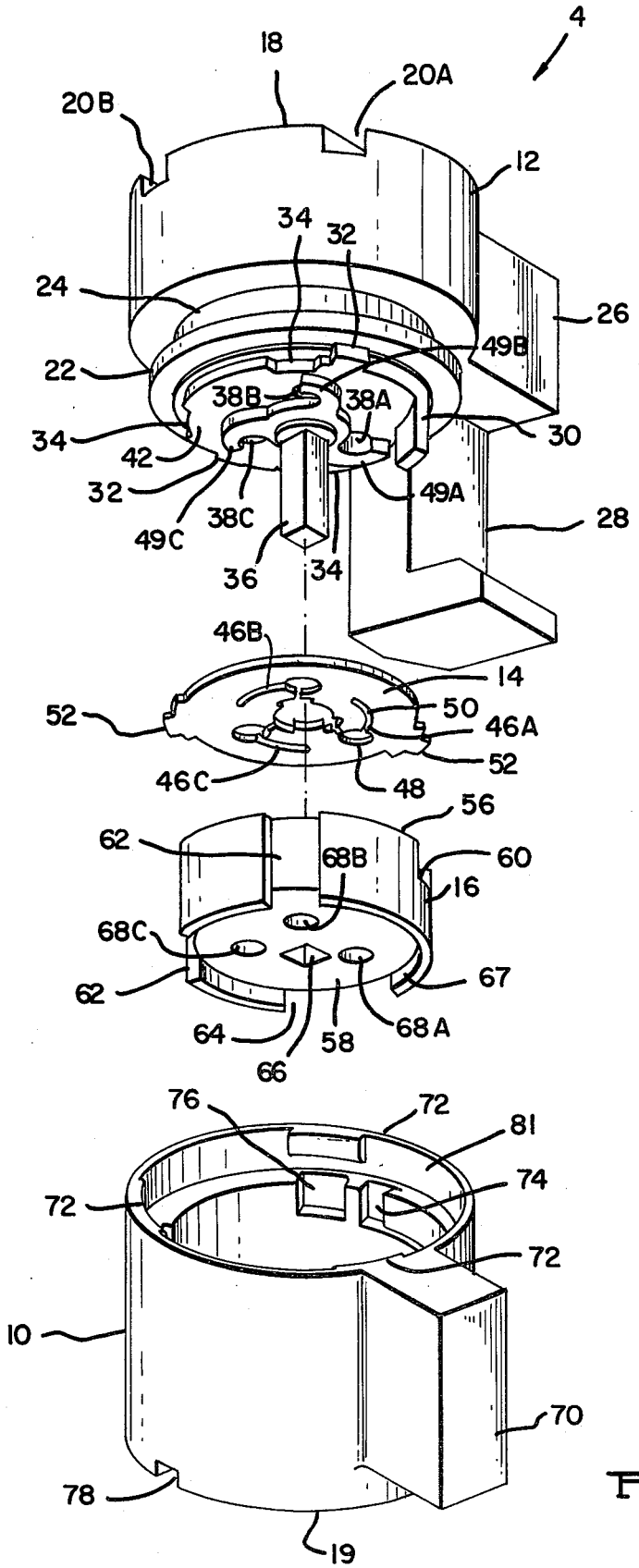
FIG. 1 is a perspective view showing the various components of the connector.

FIG. 1 is an exploded perspective view showing the various components of a rotary waterproof splice connector constructed in accordance with principles of this invention. The connector shown includes an outer casing 10 which receives a generally cylindrical plug member 12. A generally circular plate-like contact terminal 14 can be mounted on first insulating or plug member 12 between plug member 12 and second insulating or base 16, both mounted within a third insulating or casing member 10. Terminal 14, when mounted between faces 42 and 56 is free to rotate through a prescribed arc with respect to plug member 12 and base 16. When the plug assembly is in turn mounted in outer casing 10, the plug assembly too is rotatable through a similar prescribed arc relative to casing 10. In the assembled configuration, terminal 10 is fixed relative to casing 10. Two or more wires can then be spliced by inserting the wires into the plug assembly and imparting relative rotation between the outer casing 10 and the plug assembly. During rotation, suitable insulation piercing means on the terminal 14 establish the electrical interconnection between the wires.

Figures 1A, 2:
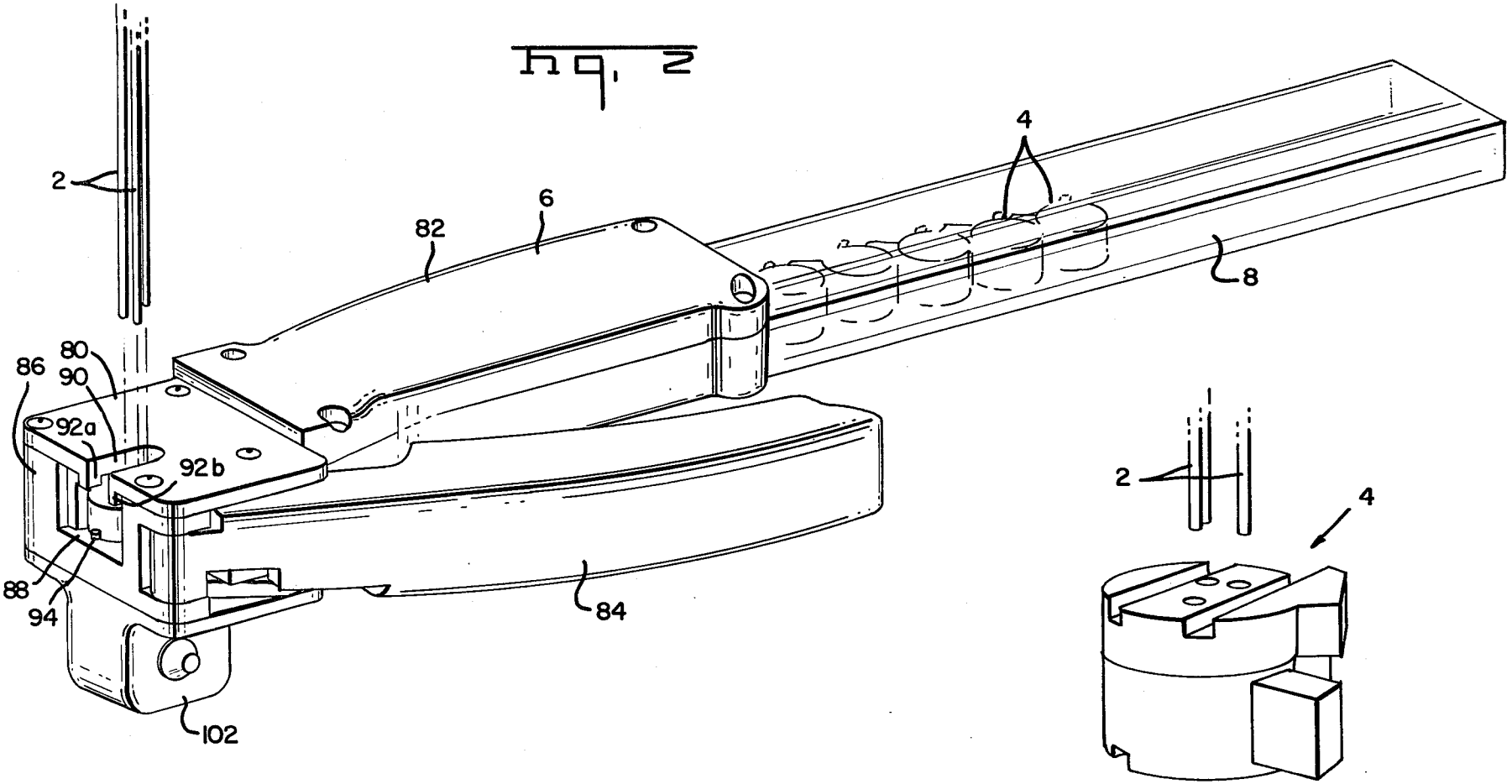
FIG. 1A is a perspective view of the assembled connector in its unterminated state.
FIG. 2 is a perspective view showing a hand tool with connectors loaded in a magazine.

FIG. 2 shows a simple hand tool which can be used to splice a plurality of conductors 2 in a given connector 4. Connectors 4 can be loaded into a magazine 8 which is in turn inserted into hand tool 6 to feed successive connectors located in tandem.

Plug member 12 best shown in FIG. 1 is generally cylindrical and is formed of a suitable insulating material such as a polyvinyl chloride. The right-circular cylindrical plug member 12 has a prismatic arm member 26 extending radially at one position on the circumferential edge. Arm 26 is generally integrally molded with plug member 12. Arm 26 has a generally rectangular recess 28 extending inwardly from one axial side. The outer or top face 18 of plug 12 has two generally parallel transverse grooves 20A and 20B, each having a generally rectangular cross-section, extending across its surface. Grooves 20A and 20B are also depicted in FIG. 1A. An annular groove 24 located intermediate the ends of plug member 12 is flanked by an annular ridge 22 and by the portion of plug member 12 adjacent to top face 18. Note that annular groove 24 is adjacent one face of rectangular indentation 28 in arm 26. An interior face 42, located on the opposite surface from top face 18, extends adjacent to and spaced from an annular ring 22. Three axially extending parallel tubular passages (see FIG. 1A) extend through plug member 12 from top face 18 to interior face 42. These three passages 38A, B and C are each equally spaced from and parallel to the central axis of rotation for plug member 12. Upstanding posts 36 is located in the center of plug member 12. Note that post 36 has a generally square cross-section. A single axially extending plug key pin 30 extends outwardly from interior face 42. This pin is located along the periphery of face 42 and is generally arcuate in cross-section. A plurality of indentations and bosses extend along the circumferential edge of the plug member adjacent to the interior face 42. Two radially extending bosses 32 are located along this circumferential edge. Three arcuate indentations 34 are also located on this circular edge. The one peripheral indentation partially obscured by post 36 in FIG. 1 is somewhat larger than the other indentations shown. Radial stuffer arms 49A, B and C extend from face 42 and are located along one wall of corresponding tubular cavities 38A, B, and C.

Metallic plate-like member 14 comprises a stamped member of a material having spring-like properties. This circular terminal member has three arcuate slots 46A, B and C equally spaced from the central axis of rotation. Slots 46 are formed by concentric edges 50 over a major portion of their respective length. The width of each slot is essentially constant. However, an enlarged wire entry portion 48 is located adjacent one end of each slot. In the embodiment shown, each wire entry portion 48 comprises a circular stamped portion. As shown in FIG. 1, the wire entry portions 48 are located at the leading edge of each slot, assuming the slots are rotated in a clockwise direction. A central hole is located immediately surrounding the central axis of rotation of terminal plate 14. Two radially extending tabs 52 are located at separate positions on the circumference of terminal 14.

A cylindrical base member 16 also formed of an insulating material such as polyvinyl chloride is located adjacent terminal plate 14. Terminal 14 is located between interior face 42 of plug 12 and interior face 56 of base 16. Face 56 is quite similar to face 42. The bottom face 58 of plug 16 is generally parallel to face 56. Three equally spaced tubular passages 68A, B and C extend from face 56 to face 58 in base 16. Axially extending tubular passages 68 are mutually parallel and equally spaced from the central axis of rotation of the connecting device. A centrally located opening 66 having a generally square cross-section also extends through plug 16 between face 56 and face 58. By inserting post 36 on plug member 12 into this square opening 66, the three axially tubular passages 68 can be precisely aligned with axial tubular passages 38A, B and C in plug member 12. A flange 67 is located on the peripheral edge of base 16. Flange 67 is interrupted by three axially extending indentations, each of which extends from face 56 past face 68. Notice that flange 67 also extends beyond face 58. One indentation, 64, is larger than the remaining two indentations 62. A fourth indentation 60 extends from face 56 to a point intermediate faces 56 and 58. It should be apparent from FIG. 1 that peripheral indentation 60 will mate with plug key member 30 when plug 12 and base 16 are mated.

The fourth component of connector 4 is an outer casing member 10. Casing 10 is similarly molded from an insulating plastic such as polyvinyl chloride. Casing 10 has a right-circular cylindrical cross-section. Circumferential wall 81 extends upwardly from circular casing bottom wall 79, to form a central cavity for receiving the plug member 12, terminal 14 and base 16. Three inwardly extending bosses 72 are located along the free end of circumferential wall 81. Spaced inwardly from bosses 72 a plurality of peripheral indentations located on the inner surface of casing member 10. Rectangular indentation 76 is apparent in FIG. 1. Indentation 74 immediately adjacent indentation 76 communicates with a second similar indentation, the view of which is obstructed in FIG. 1. A radially extending arm 70 is located on the outer surface of casing 10. Arm 70 is generally rectangular in cross-section, and is the same size as indentation 28 in plug arm 26. A laterally extending groove 78 is located on the exterior of bottom wall 79.

Figure 4:
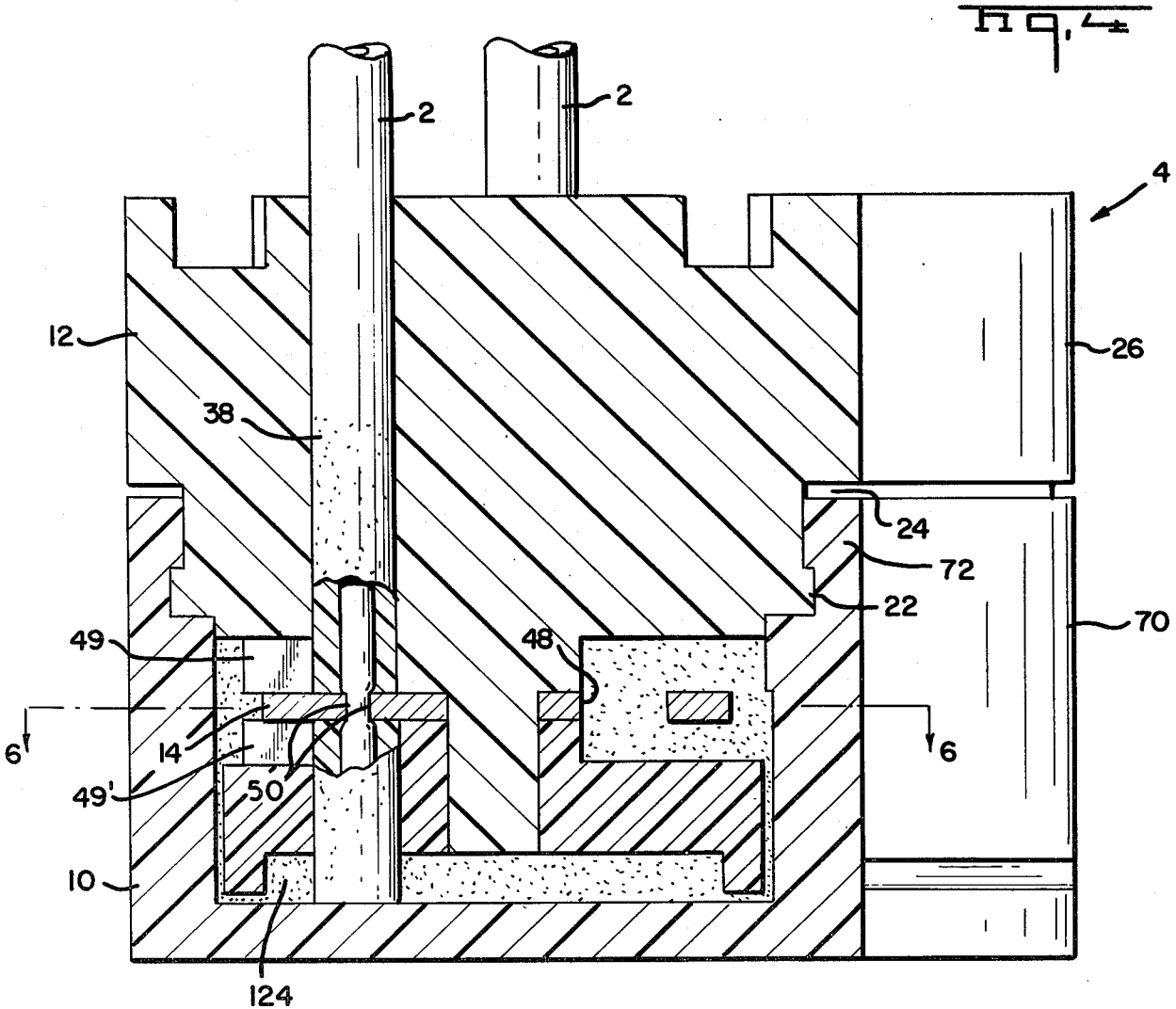
FIG. 4 is a section view similar to FIG. 3 showing a conductor after termination.

Both FIGS. 3 and 4 are transverse sections taken through connector 4. FIG. 3 shows an unterminated connector with conductors 2 in position for insertion into appropriate tubular passages 38. Each section view is taken through one tubular passage 38. Note that a viscous sealant 122 is stored in channel 38. Sealant 122 is located in at least a portion of tubular passage 38 between terminal 14 and the top face 18 of the connector and between terminal 14 and annular ring 22. This viscous sealant can be composed of a moisture-proof material having a polybutene base. Sealant 122 would be initially stored in each of the three tubular passages 38A, B and C. In the internal passage 38 shown in FIG. 3, note that terminal entry portion 48 is in alignment with tubular passage 38 so that a conductor 2 may be inserted completely into and beyond terminal 14. FIG. 3 also shows an additional internal cavity 124 located between face 16 and the bottom wall 79 of outer casing 10. This internal cavity 124 communicates with all three tubular passages 38. FIG. 3 also illustrates the manner in which plug member 12 is retained within outer casing 10. Note that the bosses 72 located on the outer rim of casing 10 can be snapped into the annular groove 24 on plug member 12. Bosses 72 are shown on either side of FIG. 3. Annular ring 22 on plug member 12 also snaps in place beneath bosses 72 on casing 10. Plug member 12 is thus retained within casing 10 and resists axial forces but remains free to rotate with respect to casing 10.

FIG. 4, taken along the same plane as the section in FIG. 3, shows a terminated connector. Note that terminal 14 has been rotated with casing 10. Rotation of terminal 14 causes slot edges 50 to penetrate the insulation of a wire 2 and establish electrical contact with the underlying conductive core of wire 2.

Figure 7:
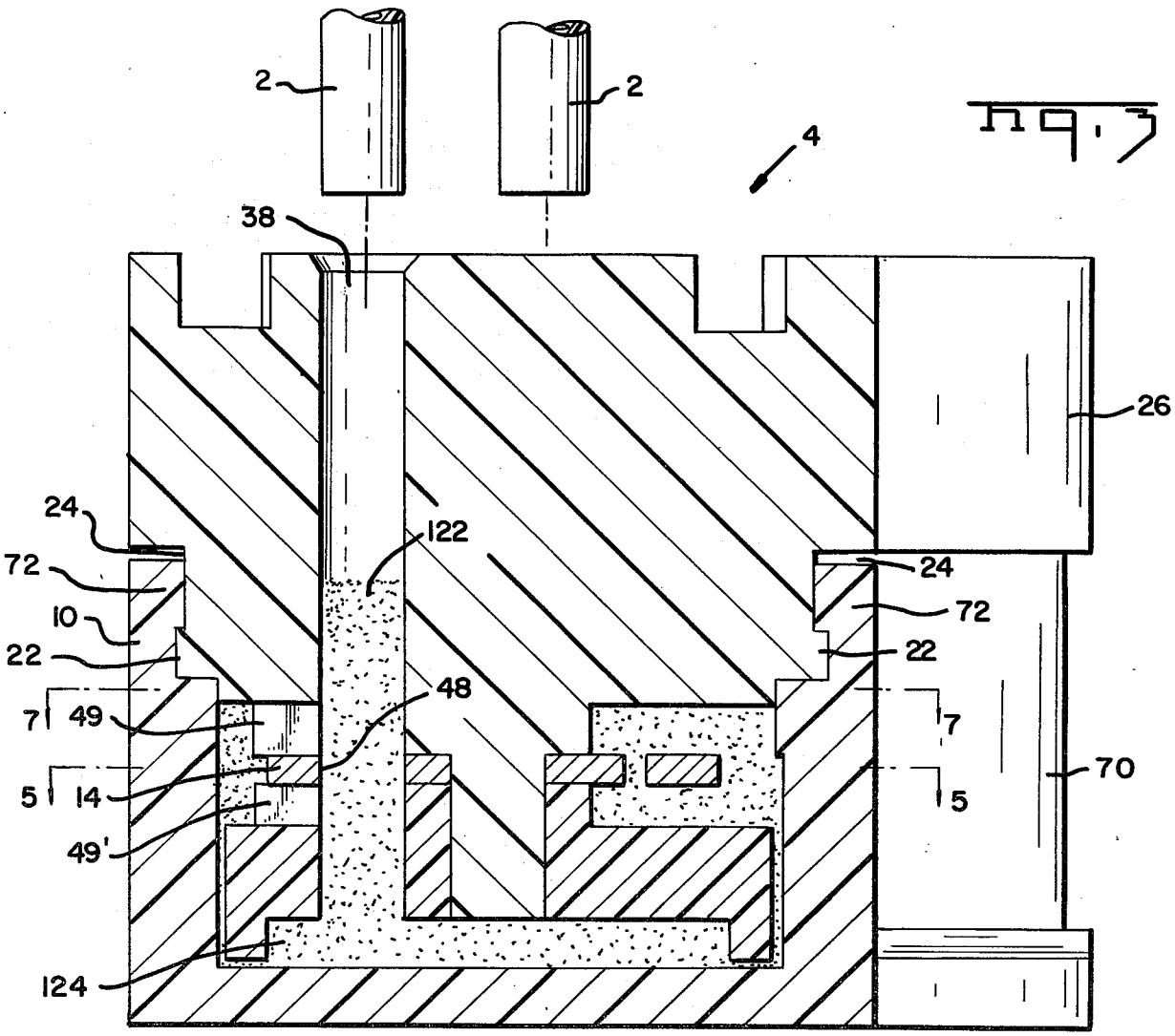
FIG. 7 is a horizontal section view showing the mating of the inner and outer housing members.
Figure 5:
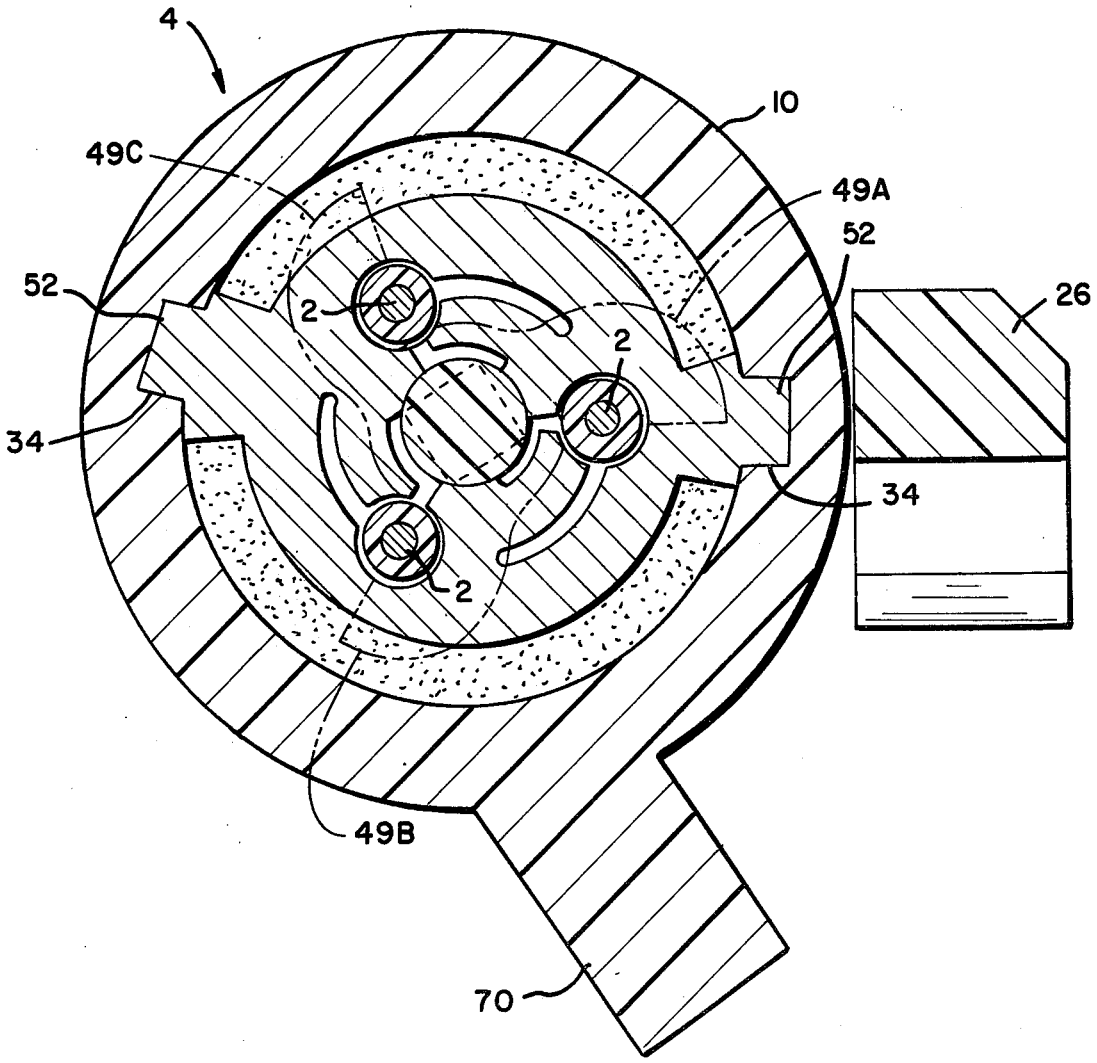
FIG. 5 is a horizontal section view through the terminal with the connector in unterminated position.
Figure 6:
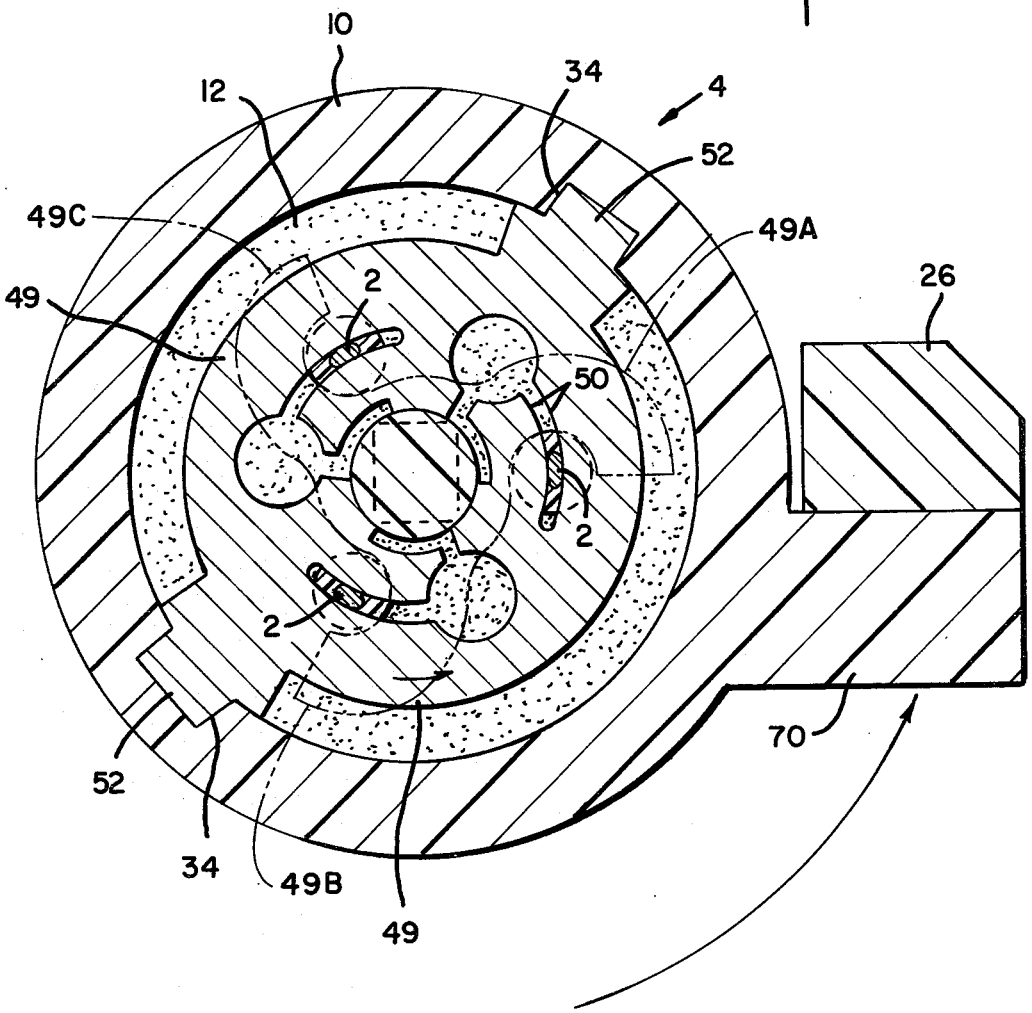
FIG. 6 is a section view similar to FIG. 5 showing the terminated position.
Figure 7:
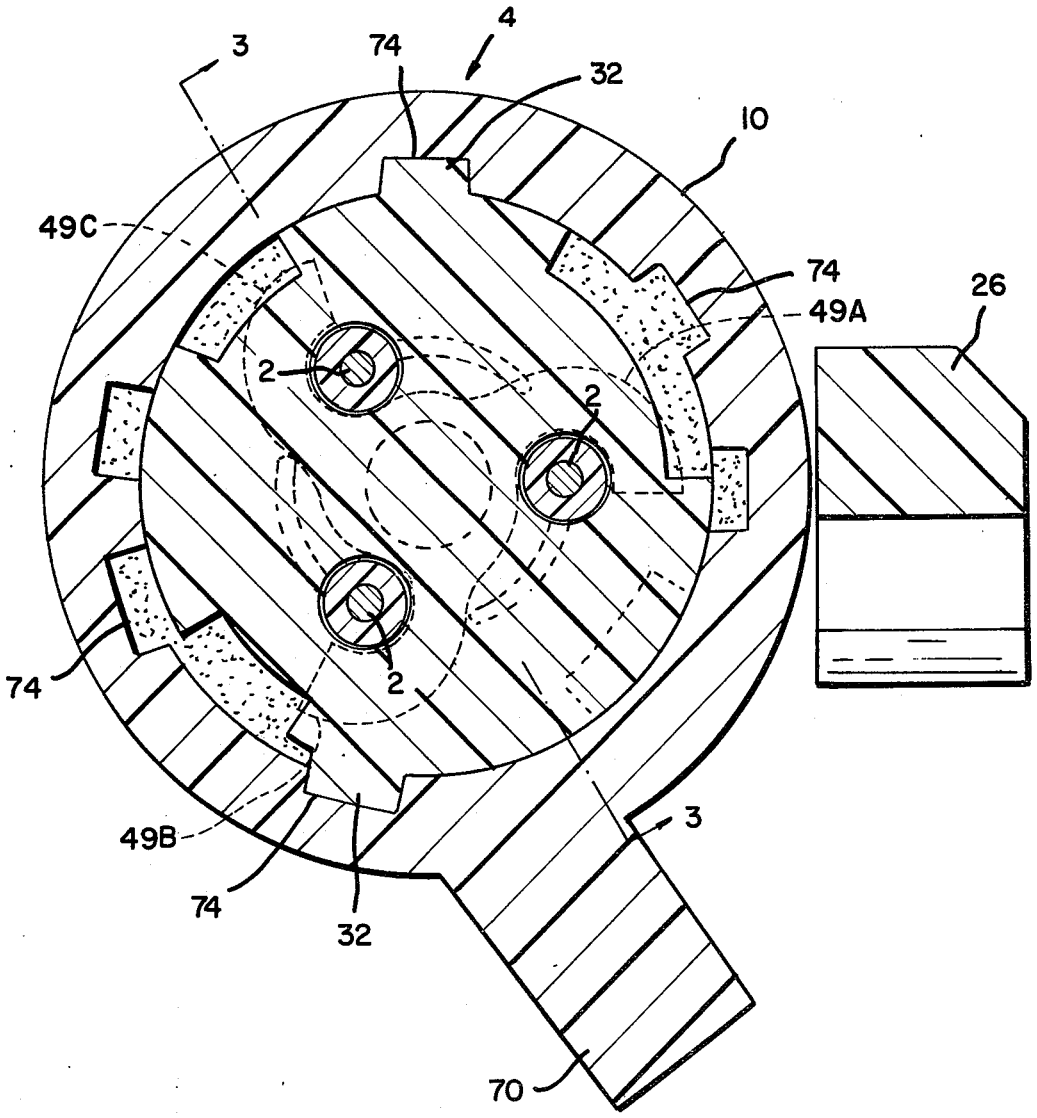
Figure 6:
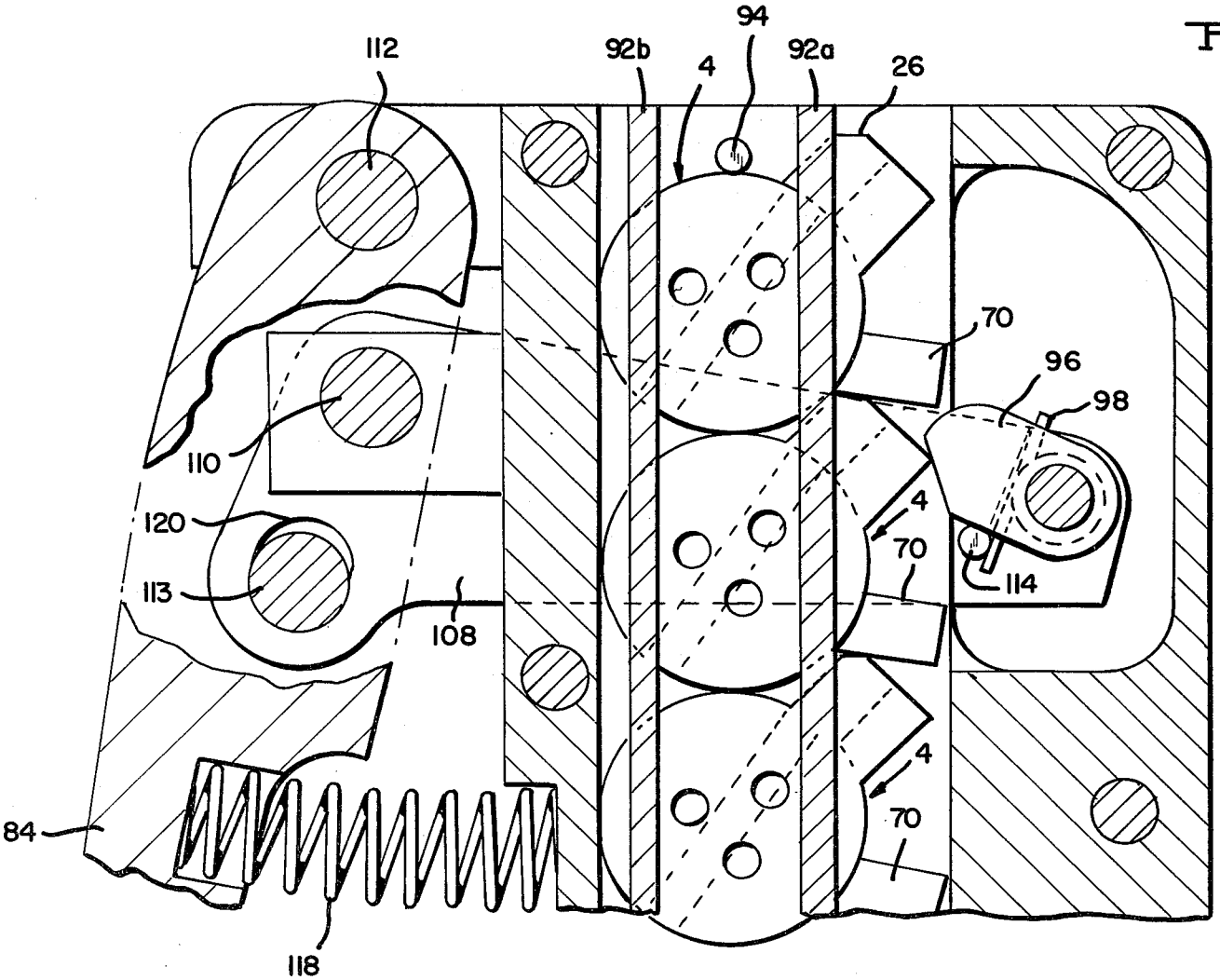

FIGS. 5, 6 and 7 are horizontal sections taken along the section lines indicated in FIGS. 3 and 4. Sections 5 and 6 are each taken through the terminal 14. FIG. 5 shows the unterminated state. FIG. 6 shows the terminated state. Note that the two terminal key tabs 52 located on the circumferential edge of terminal 14 are received within corresponding peripheral indentations 34 in casing 10. As casing 10 is rotated with respect to plug member 12, these tabs lock terminal 14 with respect to casing 10. Terminal 14 then rotates with casing 10. In FIG. 5 it should be clear that conductors 2 have been inserted into internal passages 38A, B and C. Each conductor extends through the enlarged wire entry portion 48 of the corresponding slots 46A, B and C. Radial stuffer arms 49 are shown as dotted lines in FIG. 5. It should be apparent that the viscous sealant extends around the contact interface.

FIG. 6, which illustrates the terminated state of connector 4, shows that the outer casing 10 and the terminal plate 14 have been rotated bringing the slot edges 50 into contact with the conductive core of each wire 2.

FIG. 7 which is taken along a plane parallel to section 5, shows connector 4 again in its unterminated state. Section 7 shows the interengaging relationship of the radially extending boss members 32 on plug member 12 and the corresponding indentations 74 located on casing 10. It should be noted that each boss 32 corresponds to a pair of indentations 74 on casing 10. With the connector in its open position shown in FIG. 7, the boss 32 is located in an appropriate indentation 74. The inner wall of casing 10 between each pair of indentations 74 is slightly recessed. As the outer casing 10 is moved in a counterclockwise position as seen in FIG. 7, each boss 74 will be forced out of the indentations as shown in FIG. 7, with the boss 32 being rotated into the other indentation 74. The connector 4 can thus be retained in only two positions, the unterminated position of FIGS. 5 and 7, and the completely terminated position which is shown in FIG. 6.

The configuration represented by the preferred embodiment of this invention is especially significant in view of the integrity of the electrical connection in a moisture-proof or moisture-tight environment. This integrity is due in part to the internal cavities which contain the viscous moisture-proof sealant. The sealant can be initially injected into the connector through tubular passages 38. Since bottom cavity communicates with all tubular passages 38, the sealant can flow among the three cavities shown. The sealant can also flow upward through longitudinal cavities 62 and 64 to completely encapsulate the contact terminal, the contact interface, and to seal the outer portions of the plug member adjacent to annular ring 22.

Connectors 4 can be terminated using a simple pair of pliers to rotate casing 10 relative to plug 12. Pliers can easily be used to engage radial arms 26 and 70. It will often be necessary, however, to use a more elaborate hand tool to efficiently terminate connectors 4 for splicing of two or three conductors in a field environment. Hand tool 6 shown in FIG. 2 is a tool satisfying this need. A plurality of connectors 4 can be loaded into a disposable magazine 8 which in turn can be loaded into hand tool 6. Successive connectors 4 can then be fed into a connector terminating station in terminating head 80 located at one end of the hand tool. FIG. 2 illustrates that a magazine 8 can be loaded into one handle of tool 6 and connectors will then be positioned in line with the terminating head. Magazine 8 has two longitudinally extending ribs 116A and B extending inwardly from one of the four sides of the hollow magazine 8. Ribs 116A and B are offset with respect to the centerline of magazine 8. This allows room for radially extending arms 26 and 70 of connector 4. Note in FIG. 10 that the two laterally extending grooves 20A and 20B located in the top face of connector 4 will receive ribs 116A and B when connectors 4 are loaded in a tandem relationship in magazine 8. An appropriate spring member 104 extending from the tool head region can be clipped on the rear connector thus feeding each connector successively into the terminating region. Spring 104 can be received in well member 102 located below the tool head 80. Spring 104, which resembles a clock spring, is chosen so that an essentially constant force is exerted on the row of connectors irrespective of length. Two rails 92A and 92B located on the upper surface of tool head 80 and extending into open connector feed cavity 88, serve as extensions of magazine rails 116A and 116B. These two rails 92A and 92B position the connector 4 in proper alignment. Connector feed cavity 88 comprises an open ended cavity defining a connector terminating station in tool head 80.

Figure 9:
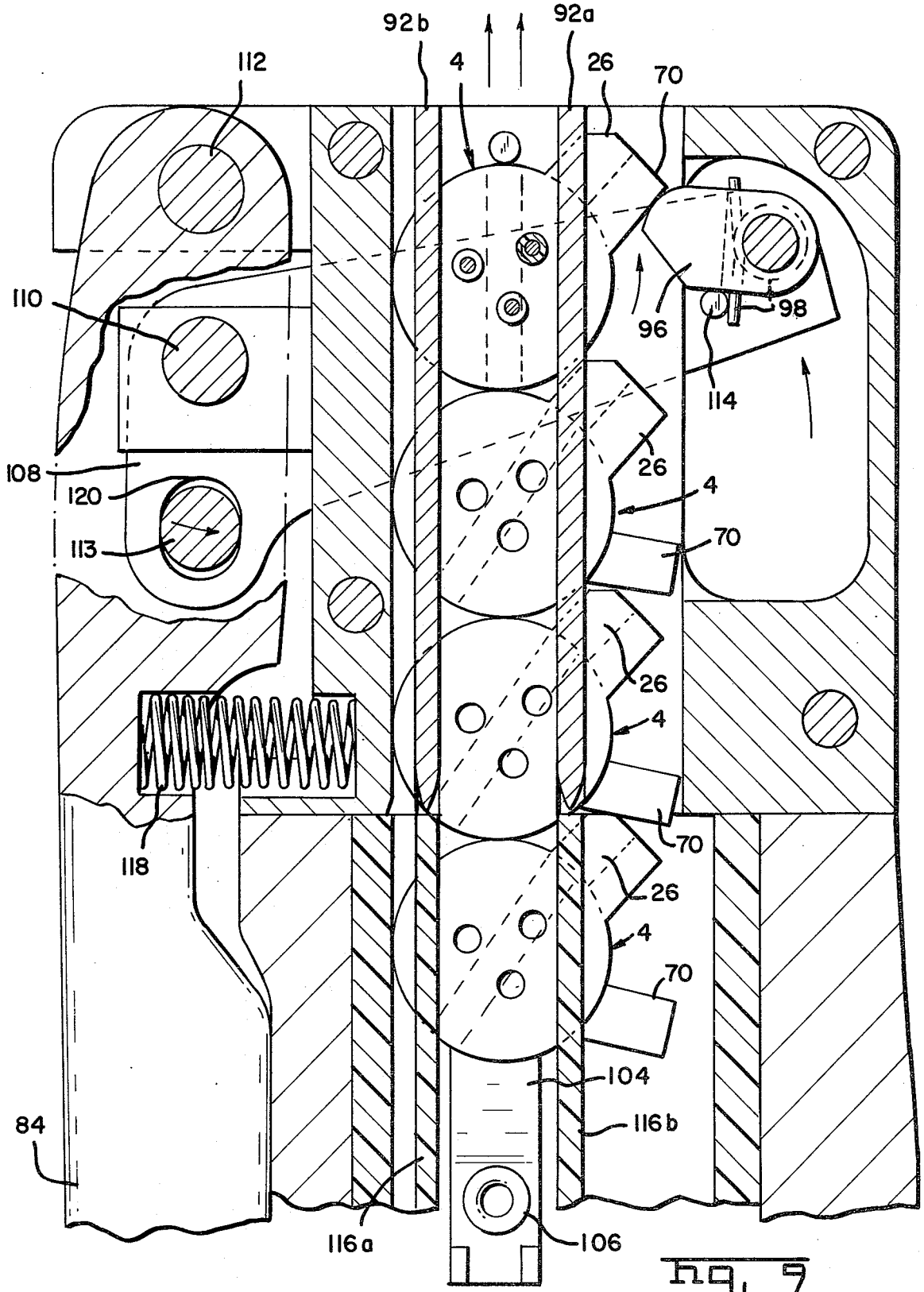
FIG. 9 is a section view similar to FIG. 8 showing the termination of a single connector.

A pawl member 96, located on one lateral side of open ended connector feed track 88, is used to impart the torque necessary to close each connector. FIG. 8 is a section view showing the foremost connector 4 in the unterminated position. Note that pawl 96 is located adjacent to laterally extending casing arm 70. Wires 2 can be inserted into terminal passages 38 through a U-shaped opening 90 located in the upper surface of tool head 80. Once the wires are in proper position the operator can now depress handle 84. Handle 84 pivots about point 112 driving toggle link 108 which is in turn pivoted about point 110. Handle 84 which is spring-loaded drives toggle link 108 through pivot pin 113 located in slightly elongated slot 120. As handle 84 is depressed, toggle link 108 is driven counterclockwise from the position of FIG. 8 to the position of FIG. 9. Pawl 96 which rests against stationary post 114 imparts a counterclockwise torque to casing arm 70. Counterclockwise rotation of casing 10 with respect to plug 12 results in counterclockwise rotation of terminal 14 with respect to each conductor 2 located in each internal passage 38. Since rails 92A and B extend through transverse channels 20A and 20B located in the top surface of plug member 12, plug 12 is prevented from rotating under the counterclockwise torque imparted by pawl 96.

Figure 10:
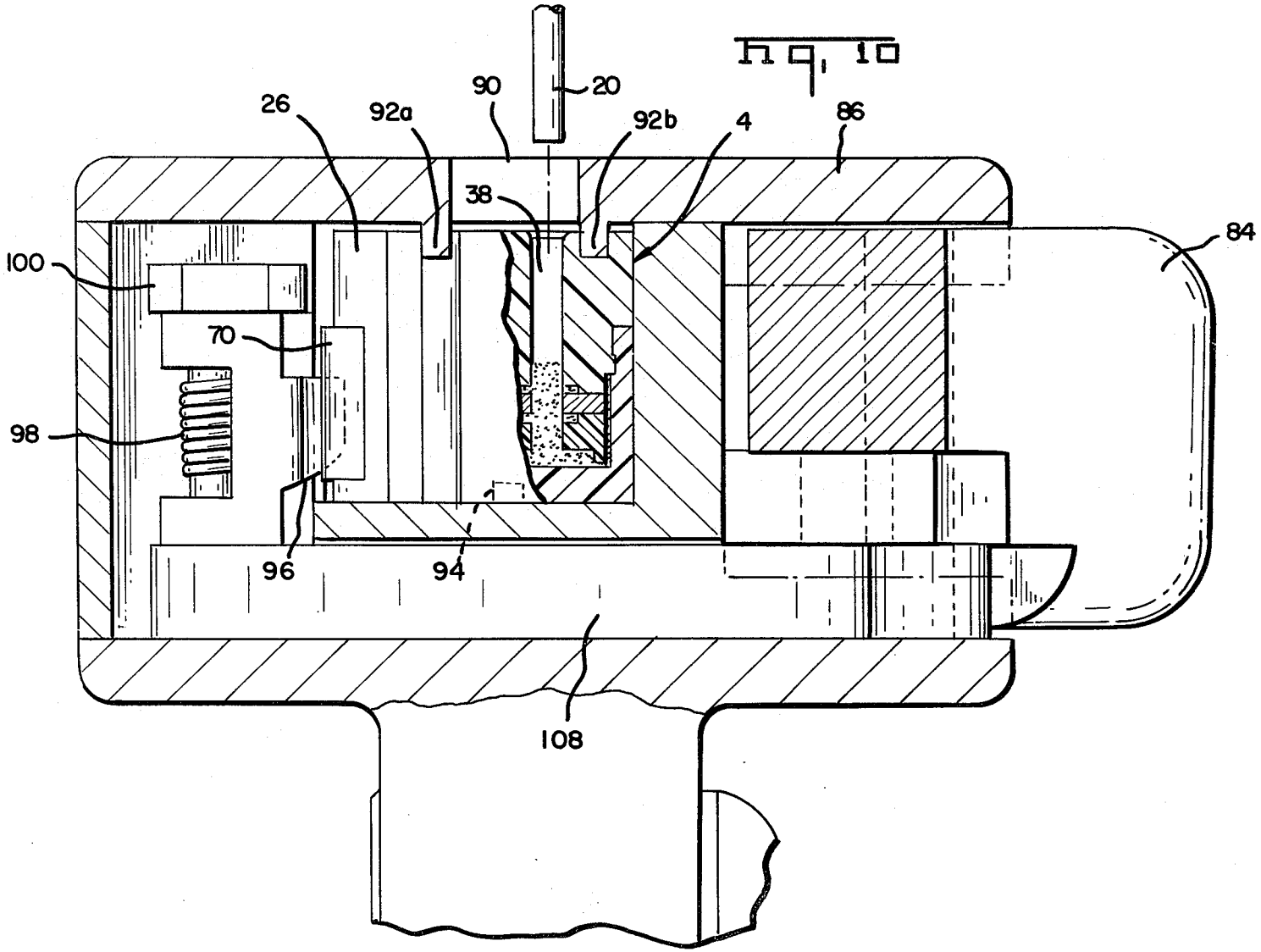
FIG. 10 is a section view in a plane perpendicular to the sections shown in FIGS. 8 and 9 showing the mechanism of the hand tool.

Each foremost connector is held in position for termination by a small centrally located pin 94 extending into open ended track 88 at the upward edge of hand tool 6. As the outer casing is rotated, the single transversely extending groove 78 located on the exterior of the bottom wall of casing 10 is likewise rotated. Groove 78 which is shown as a pair of dotted lines in FIGS. 8 and 9, moves into a position parallel to grooves 20A and 20B. At this point, connector 4 is free to move past pin 94 and out of the front edge of tool 6. The next connector can them move into position for termination. Note that pawl 96 is spring loaded and can pivot in the clockwise direction to allow each successive connector 4 and its associated pivot arms 56 and 70 to move therepast. A transverse section of a tool head with a single connector 4 located in unterminated orientation in tool 6 is shown in FIG. 10.

A rotary electrical connector employing the principles disclosed herein will establish an electrically sound moisture-proof splice for a plurality of wires. The principal embodiment shown herein is intended to be illustrative only. Numerous other embodiments employing the principles disclosed and claimed herein can be imagined, for use either in a wire splicing connector or in any of a number of well known wire terminating connectors.

What is claimed is:

1. An electrical connector for establishing electrical contact with a plurality of wires comprising:

(a) a first means further comprising an assembly of:

(i) a first insulating member having a tubular passage for each wire to be contacted extending from an exterior first face through the interior of said first insulating member to an opposite interior second face, (ii) a second insulating member having a like number of tubular passages extending therethrough from a third interior face to an opposite fourth interior face, (iii) a metallic plate-like member having a number of slots, each said slot defining a portion of a circular arc, (b) second means for securing said first insulating member to said second insulating member with said second face on said first insulating member being adjacent to said third interior face on said second insulating member and with said number of tubular passages in said first insulating member being aligned with said like number of tubular passages in said second insulating member, said second face being spaced from said third face by a distance at least equal to the thickness of said metallic plate-like member, said metallic plate-like member being positioned between said second and third face with said slots transversely aligned with said tubular passages, said metallic plate-like member being free to rotate relative to said first and second insulating members, (c) a third means comprising a third insulating member further comprising a bottom wall with an upstanding peripheral exterior wall defining an interior cavity, (d) fourth means for anchoring said plate-like member to said third insulating member to prevent relative rotation therebetween, when said first means is positioned at least partially within said cavity formed in said third insulating member, said third means being capable of rotation relative to said first means, whereby a wire may be placed in each of said aligned tubular passages extending past one of said slots so that upon rotation of second means relative to said first means, said wires enter said slots establishing electrical contact between each said wire and said plate-like member.

2. An electrical connector as set forth in claim 1 wherein said fourth means comprises radially extending protrusions located on the periphery of said metallic plate-like member and corresponding surfaces, on the interior of the peripheral wall in said third means, for engaging said protrusions.

3. An electrical connector as set forth in claim 1 wherein a portion of said tubular passages between said metallic plate-like member and said exterior first face is filled with a viscous moisture-proof sealant.

4. An electrical connector as set forth in claim 1 wherein first, second and third insulating members are cylindrical.

5. A moisture-proof electrical connector for interconnecting at least two electrical conductors, said connector comprising:

an insulating housing, said housing comprising an inner housing member partially received within and rotatable relative to an outer housing member, a plurality of axially extending tubular passages in said insulating housing, first means for establishing electrical contact with electrical conductors located in said axially extending tubular passages, said first means extending in a first plane transverse to said axially extending tubular passages, second means for rotating said first means relative to said axially extending tubular passages, in said first plane, to bring said first means into electrical contact with conductors located in said axially extending tubular passages, and a viscous moisture-proof sealant located in said axially extending tubular passages, whereby electrical contact between said conductors is established by rotary motion transverse to said axially extending tubular passages so that said viscous moisture-proof sealant is not subjected to a significant pressure differential in said axially extending tubular passages during electrical termination of said conductors.

6. A moisture-proof electrical connector as set forth in claim 5 wherein said axially extending tubular passages extend into said inner housing member.

7. A moisture-proof electrical connector as set forth in claim 6 wherein said first means is mounted on said inner housing member.

8. A moisture-proof electrical connector as set forth in claim 7 wherein said second means for rotating said first means comprises means for mounting said first means on said inner housing member with said first means being free to rotate relative to said inner housing member and means for interengaging said first means and said outer housing member to prevent relative rotation between said first means and said outer housing member, rotation of said first means relative to said axially extending tubular passages occurring as said inner housing member is rotated relative to said outer housing member.

9. A moisture-proof electrical connector as set forth in claim 8 wherein said first means comprises a metallic plate-like member having a plurality of slots, each slot being in alignment with one of said tubular passages.

10. A butt-splice connector for interconnecting at least two electrical conductors, said connector comprising:

a cylindrical outer casing formed of insulating material, a rigid arm protruding from said one side of said outer casing, a cylindrical plug member formed of insulating material and located partially within said outer casing with an exterior face of said plug member generally perpendicular to the axis of rotation of said cylindrical outer casing and said cylindrical plug member, said plug member being rotatable with respect to said outer casing about said axis of rotation, a plurality of conductor receiving passages extending from said exterior face into said plug member, means in said plug member for establishing electrical contact with conductors in said conductor receiving passages upon rotation of said outer casing relative to said plug member, and elongate channel means on said exterior face extending perpendicular to said axis of rotation, for receiving a longitudinal ridge in separate tool means to restrain rotation of said plug member up exertion of a rotational force by said separate tool means upon said rigid arm, whereby said conductors can be inserted into said conductor receiving passages of a connector positioned in said separate tool means and electrical interconnection between said conductors can be established by said conductor terminating means as said separate tool means imparts rotation to said outer casing.

* * * * *